US006217385B1

(12) United States Patent
Genta et al.

(10) Patent No.: US 6,217,385 B1
(45) Date of Patent: Apr. 17, 2001

(54) SEALING UNIT, PARTICULARLY FOR ELECTRIC CONNECTORS

(75) Inventors: Alessandro Genta, Turin; Pier Carlo Bigotto, Rivoli, both of (IT)

(73) Assignee: Framatome Connectors International S.A., Courbevoie (FR)

( * ) Notice: Subject to any disclaimer, the term of this patent is extended or adjusted under 35 U.S.C. 154(b) by 0 days.

(21) Appl. No.: 08/817,931

(22) PCT Filed: Oct. 30, 1995

(86) PCT No.: PCT/EP95/04260

§ 371 Date: Aug. 13, 1997

§ 102(e) Date: Aug. 13, 1997

(87) PCT Pub. No.: WO96/13880

PCT Pub. Date: May 9, 1996

(30) Foreign Application Priority Data

Oct. 31, 1994 (IT) ..... TO94A0868

(51) Int. Cl.[7] ..... H01R 13/40

(52) U.S. Cl. ..... 439/587; 439/942

(58) Field of Search ..... 439/587, 589, 439/465, 469, 460, 942; 174/77 R, 93; 277/603, 619, 624, 616, 627

(56) References Cited

U.S. PATENT DOCUMENTS 4,230,392 * 10/1980 Leonard, Jr. et al. ..... 439/275
4,768,970 9/1988 Nestor ..... 439/278
4,839,471 * 6/1989 Clark et al. ..... 174/92
5,445,538 * 8/1995 Rodrigues et al. ..... 439/460
5,538,441 * 7/1996 Paolucci et al. ..... 439/589

FOREIGN PATENT DOCUMENTS 0 078 750 5/1983 (EP) .
0 335 721 10/1989 (EP) .
0 574 862 12/1993 (EP) .

OTHER PUBLICATIONS

Elements of Materials Science by Lawrence H. Van Vlack, pp. 319–321, Addison Wesley Publishing Co., Inc., MA, U.S.A., 1960.*

* cited by examiner

*Primary Examiner*—Neil Abrams
(74) *Attorney, Agent, or Firm*—Pollack, Vande Sande & Amernick, R.L.L.P.

(57) ABSTRACT

A sealing unit about an elongated element, particularly a cable of an electric connector, and presenting first and second elastically deformable sealing elements facing each other, in use, on either side of the elongated element, and each having complementary first and second portions. The sealing elements are pressed against each other so that the first and second portions cooperate in sealing manner with each other, at least one of the first and second portions being deformed by the other portion to cooperate in sealing manner with the elongated element.

11 Claims, 2 Drawing Sheets

SEALING UNIT, PARTICULARLY FOR ELECTRIC CONNECTORS

TECHNICAL FIELD

The present invention relates to a sealing unit about one or more elongated elements such as cables, pipes or the like, and is particularly, though not exclusively, suitable for insertion between the casing and one or more cables of an electric connector, to which application the following description refers purely by way of example.

BACKGROUND OF THE INVENTION

The electric cable of sealed electric connectors is normally sealed by means of a sealing element having a through opening through which the cable is fitted. The sealing element may be a straightforward rubber ring for a single cable, as described for example in U.S. Pat. No. 5,069,639, or a multiple seal with a number of holes for respective cables, as described for example in U.S. Pat. No. 4,460,227. As the efficiency of the sealing element depends on its exerting a certain amount of pressure on the cable, the section of the opening must be smaller than the cross section of the cable to produce a certain amount of radial forcing when the cable is assembled.

Known sealing elements of the above type present several drawbacks.

One way of assembling the connector is to insert the cable through the sealing element before crimping the terminal on to the cable, which solution, however, involves a fairly complex, time-consuming assembly sequence. Alternatively, the sealing element may be assembled beforehand inside the casing, in which case the electric terminal, already crimped to the cable, must be fitted through the opening in the seal when the terminal is inserted inside the casing. On account of the small section of the opening in the seal, such a solution may result in severe distortion of the seal, and in tearing or cutting of the edge of the opening, thus impairing sealing efficiency in actual use. What is more, subsequent removal and reassembly may result in further damage, to the extent that the seal must eventually be replaced, with all the disadvantages this entails in terms of time and money.

SUMMARY OF THE INVENTION

It is an object of the present invention to provide a sealing unit, particularly for an electric connector, designed to overcome the drawbacks typically associated with known seals of the aforementioned type.

According to the present invention, there is provided a sealing unit about an elongated element comprising first and second elastically deformable sealing elements facing each other and gripped against each other and against the elongated element interposed between the sealing elements. The sealing elements comprise respectively at least a first and at least a second portion complementary in shape, at least one of the portions being deformable by the other to cooperate in sealing manner with the elongated element.

BRIEF DESCRIPTION OF THE DRAWINGS

Two preferred, embodiments of the present invention will now be described by way of example with reference to the accompanying drawings, in which.

PREFERRED EMBODIMENT

Figure 2:
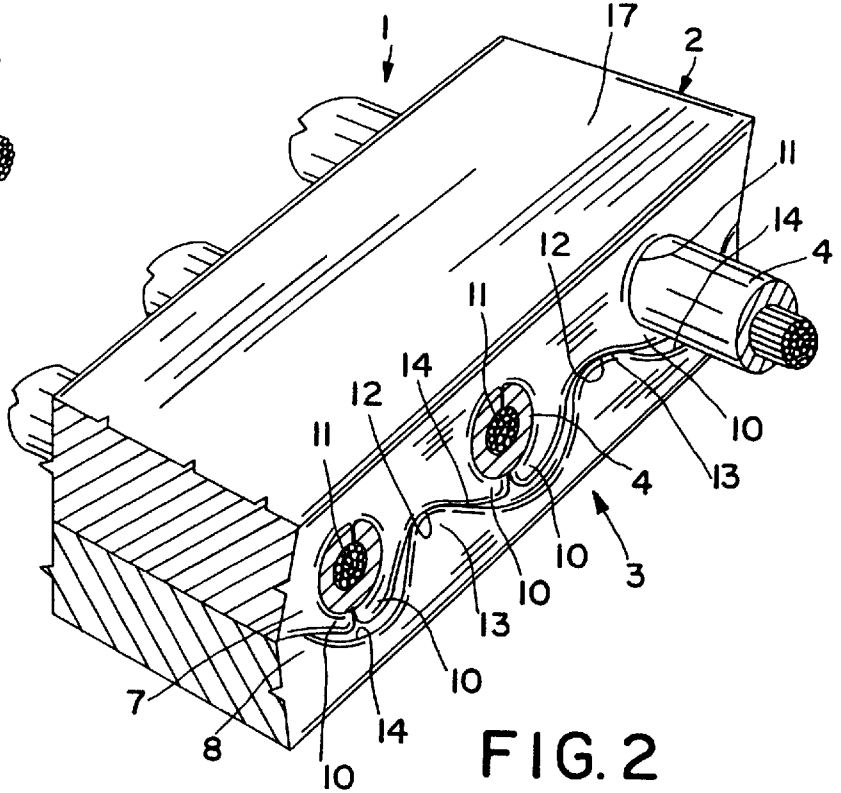
FIGS. 1 and 2 show schematic partial views in perspective of a sealing unit in accordance with the teachings of the present invention and in two different operating positions.
Figure 1:
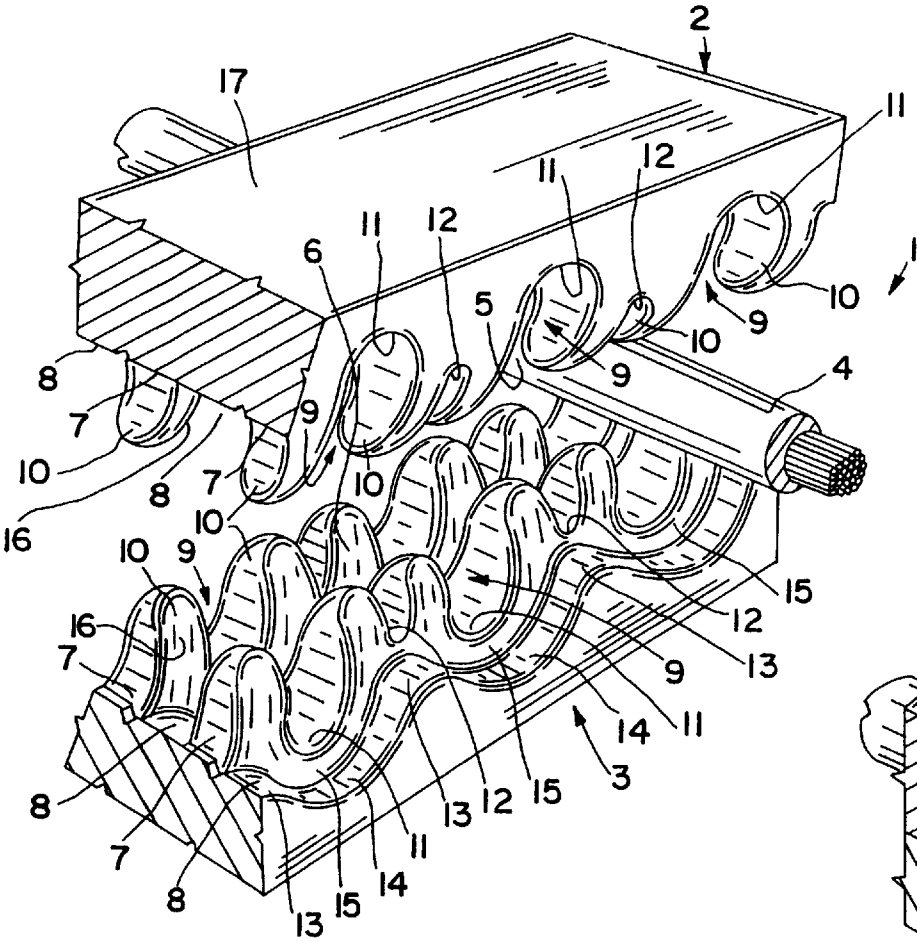

Number FIGS. 1 and 2 shows a sealing unit 1 comprising a pair of sealing elements 2, 3, which are placed together and pressed against each other to cooperate in sealing manner with a number of parallel electric cables 4 (only one shown in FIG. 1) interposed between elements 2 and 3.

Elements 2 and 3 are molded from elastomeric material, and comprise respective shaped surfaces 5, 6 facing and cooperating with each other. Each of surfaces 5, 6 presents a number of first portions 7 and second portions 8 defining bands of surfaces 5, 6 extending transversely in relation to cables 4 and alternating in a direction parallel to cables 4. Portions 7, 8 of element 2 are offset axially in relation to portions 7, 8 of element 3, so that a portion 7 of one element mates with a portion 8 of the other.

Portions 7 and portions 8 are complementary in shape. More specifically, first portions 7 comprise a number of pairs 9 of sealing lips 10; the lips 10 in each pair 9 define a C-section seat 11 of a depth greater than the diameter of cables 4, and housing a portion of a respective cable; and the adjacent lips 10 of two adjacent pairs 9 are separated by a C-section gap 12 shallower than seats 11. Second portions 8, on the other hand, present an undulated contour defined by a number of crests 13 located at gaps 12 of adjacent first portions 7, and alternating with a number of grooves 14 located at seats 11 of adjacent first portions 7.

Second portions 8 are sunk in relation to first portions 7 so as to form a shoulder 15 between the bottom of seat 11 and the bottom of adjacent groove 14. Lips 10 present a substantially trapezoidal axial section; and the lips 10 of adjacent portions 7 define respective gaps 16 also presenting a substantially trapezoidal section but slightly less than the section of lips 10 when undeformed.

Sealing elements 2, 3 present respective flat supporting faces 17 opposite surfaces 5, 6 and which cooperate in sealing manner with respective pairs of gripping elements (not shown) between which unit 1 is compressed in use.

Unit 1 operates as follows.

In FIG. 1, sealing elements 2, 3 are shown in the open position facing each other to permit insertion of cables 4 (only one shown) between respective surfaces 5, 6.

Cables 4 are inserted so as to engage seats 11 in portions 7 of each element 2, 3 when elements 2, 3 are placed together and pressed against each other (FIG. 2) to mate surfaces 5 and 6. Pairs 9 of lips 10 of portions 7 of one element 2 or 3, which almost entirely surround a respective portion of cable 4, fit inside the corresponding grooves 14 of respective portions 8 of the other element 3 or 2; and, at the same time, crests 13 of each portion 8 engage in forced manner the gaps 12 between pairs 9 of lips 10, so that lips 10 in each pair 9 are deformed about respective cable 4 and cooperate end to end.

Lips 10 thus provide for sealing the entire periphery of the cable, with the exception of the portion at which they cooperate end to end; which portion, however, is located at shoulder 15 defined by the adjacent portion 7 and which provides for preventing any infiltration. The alternating arrangement of portions 7 and 8 therefore defines a labyrinth seal for ensuring absolutely airtight sealing of cables 4; which performance is further improved by the axial force produced by the trapezoidal section of lips 10 and dimensional interference with respective gaps 16.

Figure 4:
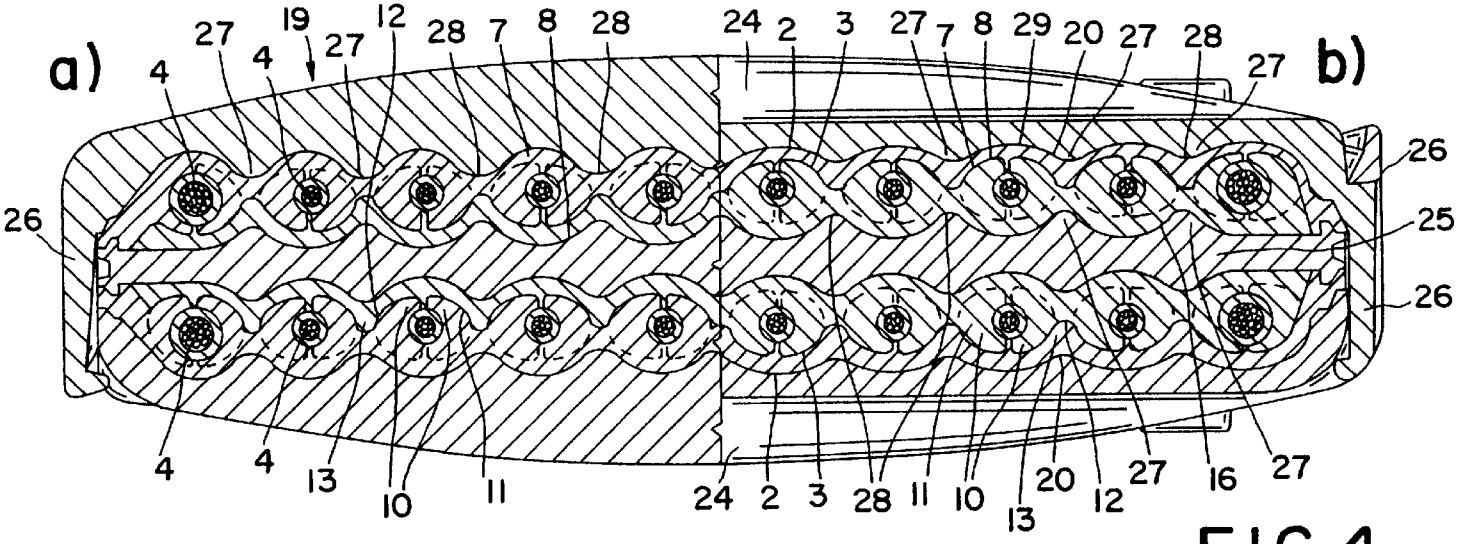
FIG. 4 shows a cross section of the FIG. 3 connector, comprising a portion a along line IVa—IVa, and a portion b along line IVb—IVb in FIG. 3.
Figure 3:
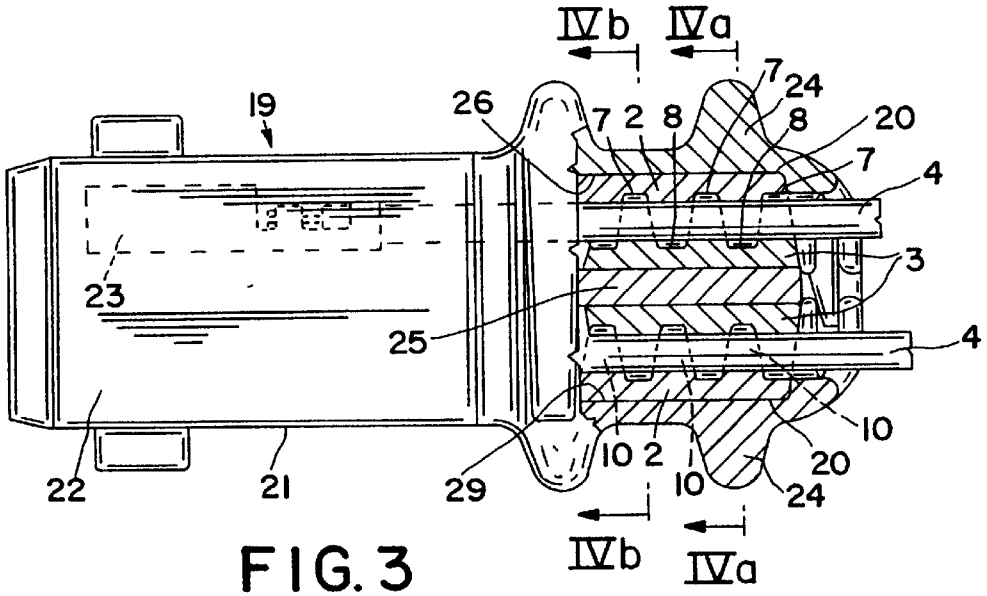
FIG. 3 shows a partially sectioned longitudinal view of an electric connector featuring a pair of sealing units according to the present invention.

FIGS. 3 and 4 show an electric connector 19 featuring a pair of sealing units 20 in accordance with the teachings of the present invention.

Connector 19 comprises an insulating casing 21 in turn comprising a main body 22 with two rows of cavities (not shown) housing respective electric terminals 23; and two shells 24 snapped together on either side of an intermediate wall 25 of body 22 separating the two rows of cavities and projecting from body 22 so as to separate the two rows of cables 4 of respective terminals 23.

Each shell 24 defines with wall 25 a chamber 29 housing a respective sealing unit 20. Each unit 20 comprises a sealing element 2 and a sealing element 3 with respective surfaces 5, 6 as described with reference to unit 1 in FIGS. 1 and 2; and elements 2, 3 are compressed against each other between respective shell 24 and wall 25, and cooperate in sealing manner with opposite sides of cables 4. Shells 24 are secured to each other by means of elastic snap-on fasteners, and are retained on wall 25 in the direction parallel to cables 4 by retaining means not shown.

To ensure stable transverse positioning of elements 2, 3 and enhance the sealing effect due to interaction of portions 7 and 8, wall 25 and shells 24 are conveniently undulated and defined by a number of equally spaced projections 27 cooperating with respective recesses 28 formed in surfaces 17 of sealing elements 2, 3 at crests 13 of portions 8 and gaps 12 of portions 7.

The advantages of units 1 and 20 according to the present invention are as follows.

By virtue of the sealing unit being formed in two separate parts between which the cables are inserted, it may be assembled and disassembled with the terminals already crimped to the respective cables 26, with no need to force the terminals through small-section openings as with known one-piece seals. Moreover, when gripped together against the cable, the complementary shape of the two sealing elements causes them to flex into sealing contact with the cable. And finally, the axially alternating arrangement of portions 7 and 8 defines a labyrinth seal ensuring substantially airtight sealing of the unit.

Clearly, changes may be made to units 1 and 20 as described and illustrated herein without, however, departing from the scope of the present invention. For example, changes may be made to the number of portions 7, 8; to the number of cables 4 for sealing; or to the shape of lips 10 and respective seats 11.

What is claimed is:

1. A sealing unit about an elongated element, comprising first and second elastically deformable sealing elements facing each other and gripped against each other and against said elongated element interposed between them, said sealing elements comprising respectively at least one first portion and at least one second portion complementary and intermatable in shape, at least one of said portions being deformable by the other of said portions to cooperate in a sealing manner to form a fluid-tight seal with said elongated element.

2. The sealing unit claimed in claim 1, wherein said first portion comprises at least one pair of sealing lips defining a seat for said elongated element, and said second portion comprises at least one groove for receiving said sealing lips and deforming them against said elongated element.

3. The sealing unit claimed in claim 2, wherein said first portion comprises a plurality of said pairs of sealing lips cooperating with respective said elongated elements and separated by respective gaps, said second portion having an undulated contour defined by a plurality of grooves alternating with a plurality of crests cooperating in a forced manner with said gaps of said first portion.

4. The sealing unit claimed in claim 3, wherein each of said sealing elements has a plurality of said first and second portions alternating in a direction parallel to said elongated elements.

5. The sealing unit claimed in claim 4, wherein said second portions of each said sealing element have a recessed profile in relation to said first portions, a shoulder being formed between bottoms of seats in each said first portion and bottoms of grooves in an adjacent said second portion.

6. The sealing unit claimed in claim 4, wherein said sealing lips of said first portions of each said sealing element are so shaped as to engage in forced manner a gap defined between the sealing lips of a pair of said first portions of the other said sealing element.

7. A sealing unit for an electric connector and which is interposed between a casing and at least one cable of said connector, said sealing unit comprising first and second elastically deformable sealing elements facing each other on either side of said cable and being pressed against each other and against said cable, said sealing elements comprising at least one first portion and at least one second portion complementary and intermatable in shape, at least one of said first and second portions being deformable by the other of said portions to cooperate in a sealing manner to form a fluid-tight seal with said cable.

8. An electric connector comprising an insulating casing, at least one electric terminal housed in said casing and presenting a respective cable, and sealing means interposed between said cable and said casing, said sealing means comprising at least one sealing unit as claimed in claim 1.

9. The electric connector claimed in claim 8, wherein said sealing unit is compressed between a fixed portion and a movable element of said casing.

10. The connector claimed in claim 9, wherein said sealing elements of said sealing unit comprise respective shaped supporting surfaces presenting recesses at gaps and crests of said first and second portions, said fixed portion and said movable element of said casing having respective numbers of projections cooperating with said recesses.

11. A sealing unit about an elongated element, comprising first and second elastically deformable sealing elements facing each other and gripped against each other and against said elongated element interposed between them, said sealing elements comprising respectively at least one first portion and at least one second portion complementary in shape, at least one of said portions being deformable by the other of said portions to cooperate in a sealing manner to form a fluid-tight seal with said elongated element, wherein said first portion comprises at least one pair of sealing lips defining a seat for said elongated element, and said second portion comprises at least one groove for receiving said sealing lips and deforming them against said elongated element.

* * * * *